US007025198B2

(12) United States Patent
Bekele et al.

(10) Patent No.: US 7,025,198 B2
(45) Date of Patent: Apr. 11, 2006

(54) ABSORBENT PAD WITH CONTROLLED RATE OF WICKING

(75) Inventors: Solomon Bekele, Taylors, SC (US); Richard E. Douglas, III, Simpsonville, SC (US); Grady Franklin Vaughn, Jr., Winona, MS (US); David Kinard, Grenada, MS (US); Charles Kannankeril, North Caldwell, NJ (US)

(73) Assignee: Cryovac, Inc., Duncan, SC (US)

( * ) Notice: Subject to any disclaimer, the term of this patent is extended or adjusted under 35 U.S.C. 154(b) by 219 days.

(21) Appl. No.: 10/335,583

(22) Filed: Dec. 31, 2002

(65) Prior Publication Data

US 2004/0126513 A1 Jul. 1, 2004

(51) Int. Cl.
*B65D 75/00* (2006.01)

(52) U.S. Cl. ..... 206/204; 426/392; 426/129; 426/124; 426/326; 428/76

(58) Field of Classification Search ..... 206/204; 426/129
See application file for complete search history.

(56) References Cited

U.S. PATENT DOCUMENTS

| | | | | |
|---|---|---|---|---|
| 3,661,815 | A * | 5/1972 | Smith | 525/54.32 |
| 3,700,096 | A * | 10/1972 | Reifers | 229/162.4 |
| 3,713,849 | A * | 1/1973 | Grindrod et al. | 426/123 |
| RE30,009 | E | 5/1979 | Perdue et al. | |
| 4,654,039 | A | 3/1987 | Brandt et al. | |
| 4,818,548 | A * | 4/1989 | Cheng | 426/265 |
| 4,940,621 | A * | 7/1990 | Rhodes et al. | 428/137 |
| 5,022,945 | A * | 6/1991 | Rhodes et al. | 156/253 |
| 5,055,332 | A * | 10/1991 | Rhodes et al. | 428/74 |
| 5,093,176 | A * | 3/1992 | Pribonic et al. | 428/76 |
| 5,096,722 | A | 3/1992 | Bair | |
| 5,135,787 | A | 8/1992 | Bair | |
| 5,176,930 | A * | 1/1993 | Kannankeril et al. | 426/124 |
| 5,250,310 | A * | 10/1993 | Fujino et al. | 426/124 |
| 5,254,354 | A * | 10/1993 | Stewart | 426/106 |
| 5,346,735 | A | 9/1994 | Logan et al. | |
| 5,348,752 | A * | 9/1994 | Gorlich | 426/129 |
| 5,439,132 | A * | 8/1995 | Gorlich | 220/257.1 |

(Continued)

FOREIGN PATENT DOCUMENTS

EP 893 482 A 1/1999

(Continued)

*Primary Examiner*—Gregory Vidovich
*Assistant Examiner*—Dolores R. Collins
(74) *Attorney, Agent, or Firm*—Alston & Bird LLP

(57) ABSTRACT

The invention provides an absorbent pad for a case-ready package that has a controlled rate of wicking. The packaging comprises a support member, a food product that exudes liquids positioned on the support member, an absorbent pad between the food product and the support member, and a lid member enclosing the package. The absorbent pad is composed of an upper layer, an intermediate absorbent layer, and a lower layer. The upper and lower layers extend beyond the periphery of the absorbent layer and are attached directly to one another. Preferably, the upper and lower layers are composed of nonwoven materials that are coated with a hydrophilic composition. Typically the upper layer will be a spunbonded/meltblown/spunbonded web and the lower layer will be a spunbonded web. The hydrophilic coating wicks liquid exuded by the food product into the absorbent layer, and therefore prevents the accumulation of liquids within the support member. Changing the amount of hydrophilic coating on the upper layer will decrease or increase the rate of wicking that occurs at the upper layer. Thus, to prevent drying from occurring within the food product the rate of wicking can be controlled by changing the amounts of hydrophilic coating present on the layers.

36 Claims, 10 Drawing Sheets

U.S. PATENT DOCUMENTS 5,552,169 A * 9/1996 Kannankeril et al. ..... 426/107
5,747,082 A * 5/1998 Floyd et al. ..... 426/109
5,770,287 A 6/1998 Miranda et al.
5,820,955 A * 10/1998 Brander ..... 428/35.7
5,896,994 A * 4/1999 Krebs ..... 206/524.4
5,908,649 A * 6/1999 Floyd et al. ..... 426/109
6,015,582 A * 1/2000 Kageyama et al. ..... 426/392
6,015,585 A * 1/2000 Yamaguchi et al.
6,023,915 A * 2/2000 Colombo ..... 53/432
6,085,930 A * 7/2000 Curtis ..... 220/371
6,095,325 A 8/2000 Simhaee
6,270,873 B1 * 8/2001 Darnett ..... 428/76
6,376,034 B1 * 4/2002 Brander ..... 428/35.2
6,447,892 B1 * 9/2002 Hatley et al. ..... 428/218
6,602,590 B1 * 8/2003 Ting et al. ..... 428/218
6,695,138 B1 * 2/2004 Colombo et al. ..... 206/204
2002/0096291 A1 * 7/2002 Hansen et al. ..... 162/173
2002/0096292 A1 * 7/2002 Hansen et al. ..... 162/173
2003/0035867 A1 * 2/2003 Kinard et al. ..... 426/124

FOREIGN PATENT DOCUMENTS

GB 2 214 201 A 8/1989
GB 2 325 195 A 11/1998

* cited by examiner

ABSORBENT PAD WITH CONTROLLED RATE OF WICKING

FIELD OF THE INVENTION

This invention relates to a food package of the type used to contain and display various foods, and more particularly to a food package containing a food product that exudes liquids, such as meat products, with the package containing an absorbent pad for the liquid exudates.

BACKGROUND OF THE INVENTION

It is now the customary practice for a retail grocer to receive meat and poultry products pre-packaged and ready to display to the consumer. This packaging format, commonly known as case-ready packaging, allows the consumer to select among the available choices for a food item that is the desired size and has the freshest appearance, while promoting efficiencies in distribution and display.

The conventional form of case-ready package includes a rigid support member, such as a flat sheet or tray, upon which the product is supported. The tray is usually sealed with a lidding film that is applied over the top of the tray and food product and sealed to the edges of the tray to enclose the food in the package. An absorbent pad is typically placed between the support member and the food product to absorb any excess liquids exuded by the product. Typically, the absorbent pad comprises three layers: an upper layer; a lower layer; and an intermediate absorbent layer that is completely enclosed between the upper and lower layers.

The absorbent pad is normally hidden from the consumer's sight. The absorbent pad improves the appearance of the package by precluding free exudates from gathering in the corners, reducing the possibility of bacterial growth, and reducing the opportunities for seal failure. The presence of free liquids is unsightly to the consumer and may result in the product not being selected for purchase.

Typically, a packaged product containing poultry requires an absorptive pad having superior absorption capabilities. Not only does poultry, in and of itself, exude large quantities of liquids, but eviscerated poultry carcasses are normally dipped into a chilled bath that can add up to 8 percent water weight to each carcass. Current trends in the market include selling moisture enhanced meat products. For example, meat products, including poultry and beef, may be marinated in seasoned liquids before being packaged. As a result, after packaging, the processed poultry and meat products normally continue to exude not only their own natural liquids over time, but typically exude liquids that have been absorbed during the marinating and dipping processes.

Absorbent pads incorporate a number of different designs. The predominant design features an absorbent pad having three layers: an upper layer, lower layer, and an intermediate absorbent layer sandwiched between the upper and lower layers. Preferably, the intermediate absorbent layer is completely enclosed between the upper and lower layers, and the upper and lower layers are sealed directly to one another, so that there is no contact between the food and the intermediate absorbent layer. For example, U.S. Pat. Nos. 4,940,621, 5,055,332 and 5,022,945 to Rhodes et al. disclose an absorbent pad comprising top and bottom layers that are made of a liquid impervious film. The films have slits cut in at least one of the layers whereby liquids are transported away from the bottom of the support member and are absorbed into the intermediate absorbent layer. A number of different materials have been used in the absorbent layer. For example, U.S. Pat. No. 6,095,325 to Simhaee et al. discloses the use of a combination of wood fluff and tissue as an absorbent layer. U.S. Pat. No. 4,654,039 to Brandt et al. teaches the use of a superabsorbent polymer ("SAP") to absorb excess liquids into the absorbent layer.

A need exists to provide an absorbent pad that removes excess liquids from within the package at a rate that can be adjusted depending upon the moisture content of the product that is to be packaged so that liquids are quickly removed without drying out the food.

SUMMARY OF THE INVENTION

The invention provides a new absorbent pad having upper and lower nonwoven layers for use in a case-ready package that is especially adapted to quickly absorb liquids exuded by a food product having a high moisture content.

The absorbent pad is composed of an upper layer, a lower layer, and an inner absorbent core. The upper and lower layers are made from nonwoven webs of thermoplastic synthetic filaments, such as polyolefin, polyester, polyethylene, or polyamide filaments. In one embodiment the upper layer is a spunbonded/meltblown/spunbonded (SMS) web and the lower layer is a spunbonded web. In a second embodiment, both layers are made from a spunbonded web, and in a third embodiment both layers are made from a SMS web. Both the upper and lower layers are coated with a hydrophilic composition that attracts and pulls the liquid exudates into an intermediate absorbent layer.

The intermediate layer may comprise several alternative materials that are capable of absorbing and retaining water and other juices, as well as fats and oils or greases, simultaneously. Examples are wood pulp and melt blown discontinuous fibers having SAP dispersed therein. The upper and lower layers of the pad are preferably secured together around their periphery to enclose the intermediate layer therebetween. Typically, the upper and lower layers are adhered to each other with an adhesive or by forming a heat seal.

The rate of absorbency is controlled depending upon the characteristics of the food product by increasing or decreasing the amount of hydrophilic coating on the upper and lower layers. The lower layer will usually have a greater amount of hydrophilic coating than the upper layer, so that the lower layer wicks liquids at a greater rate than the upper layer. Preferred hydrophilic coatings include food grade alkylphenol ethoxylates, alkylphenyl polyethylene glycol ethers, polysorbates, exothylated linear alcohols, fatty amine oxides, alkanolamides and block copolymers of ethylene oxide and propylene oxide and dimethylsiloxane based that are couple together to polar groups such as poly(oxyethylene) containing the hydrophilic moiety, and mixtures thereof.

In one embodiment of the invention the amount of hydrophilic coating on the upper and lower layers is between 0.1 to 1.0 percent based on the weight of the layer. In a preferred embodiment the amount of hydrophilic coating on the lower layer is between 0.5 to 1.0 percent based on the weight of the lower layer, and the amount of hydrophilic coating on the upper layer is between 0.1 to 0.35 percent based on the weight of the upper layer.

A second aspect of the invention provides a case-ready package that contains a food product that exudes liquids. The case-ready package comprises a support member containing a food product, an absorbent pad that is in accordance with the first aspect of the invention disposed between the support member and the food product, and a lid member enclosing the package.

Preferably, the support member is a foam, thermoformed, or other rigid plastic tray that supports the food product. The absorbent pad is placed on the surface of the tray between the tray and the food product. The lid member is normally a flexible transparent or printed film that is typically heat bonded to the tray, thereby enclosing the food product within. The space surrounding the food product between the lid member and the tray may be air, vacuum, or a modified atmosphere. The food product is normally meat, poultry, cheese, or produce, especially poultry and beef having a high moisture content.

BRIEF DESCRIPTION OF THE DRAWINGS

Figure 1:
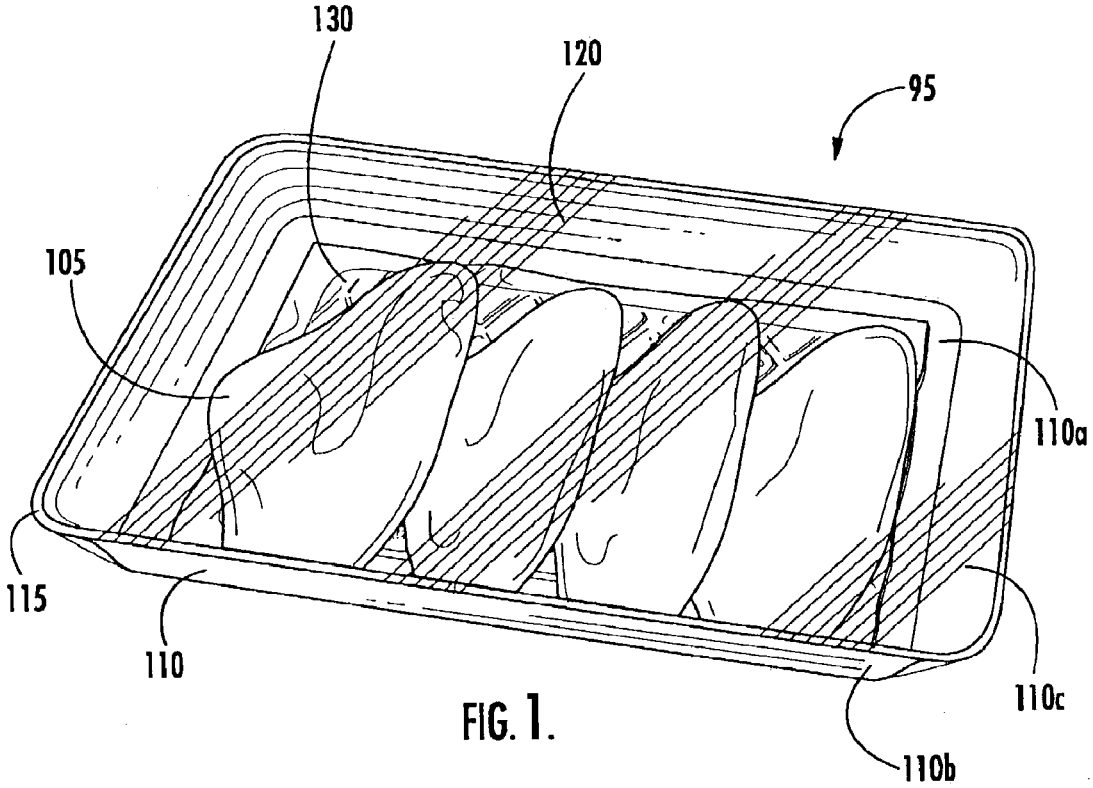
Figure 2:
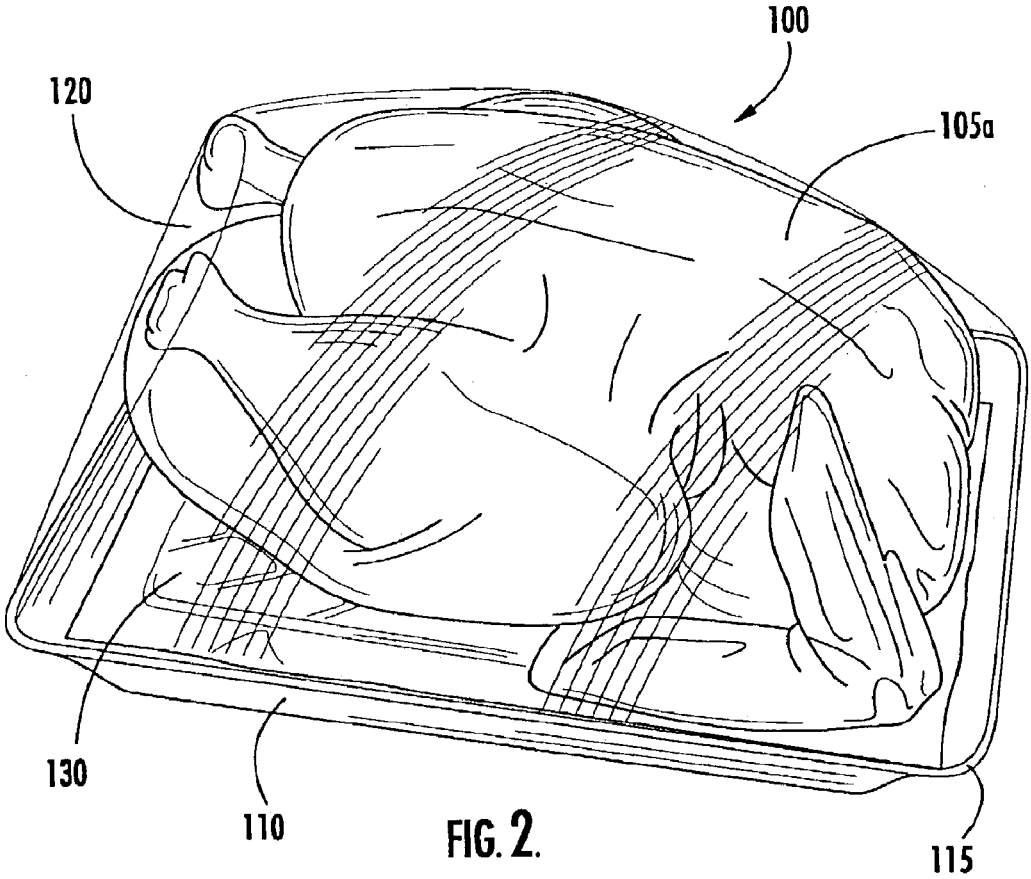
Figure 3:
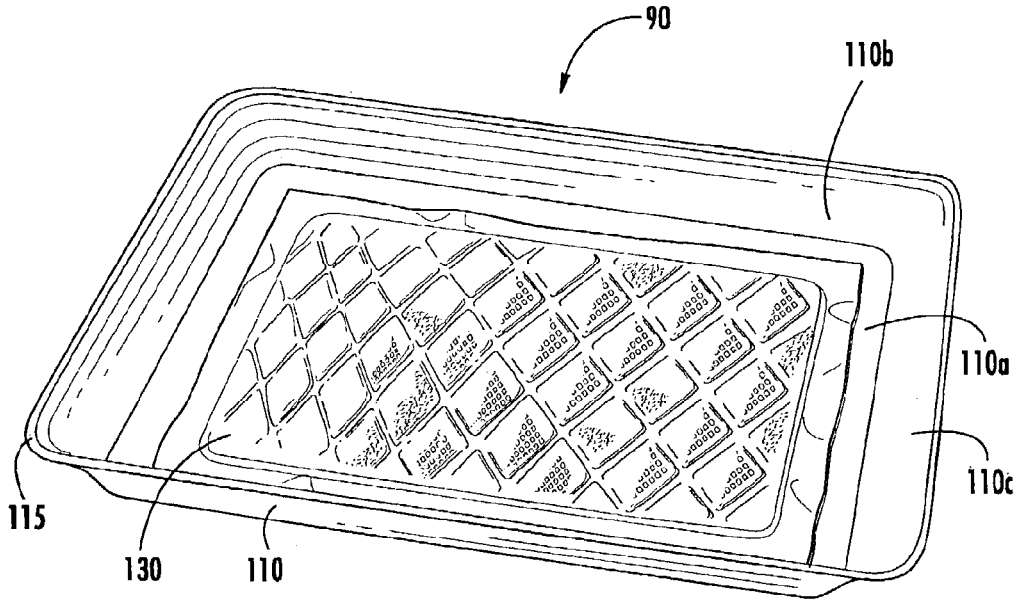
Figure 4:
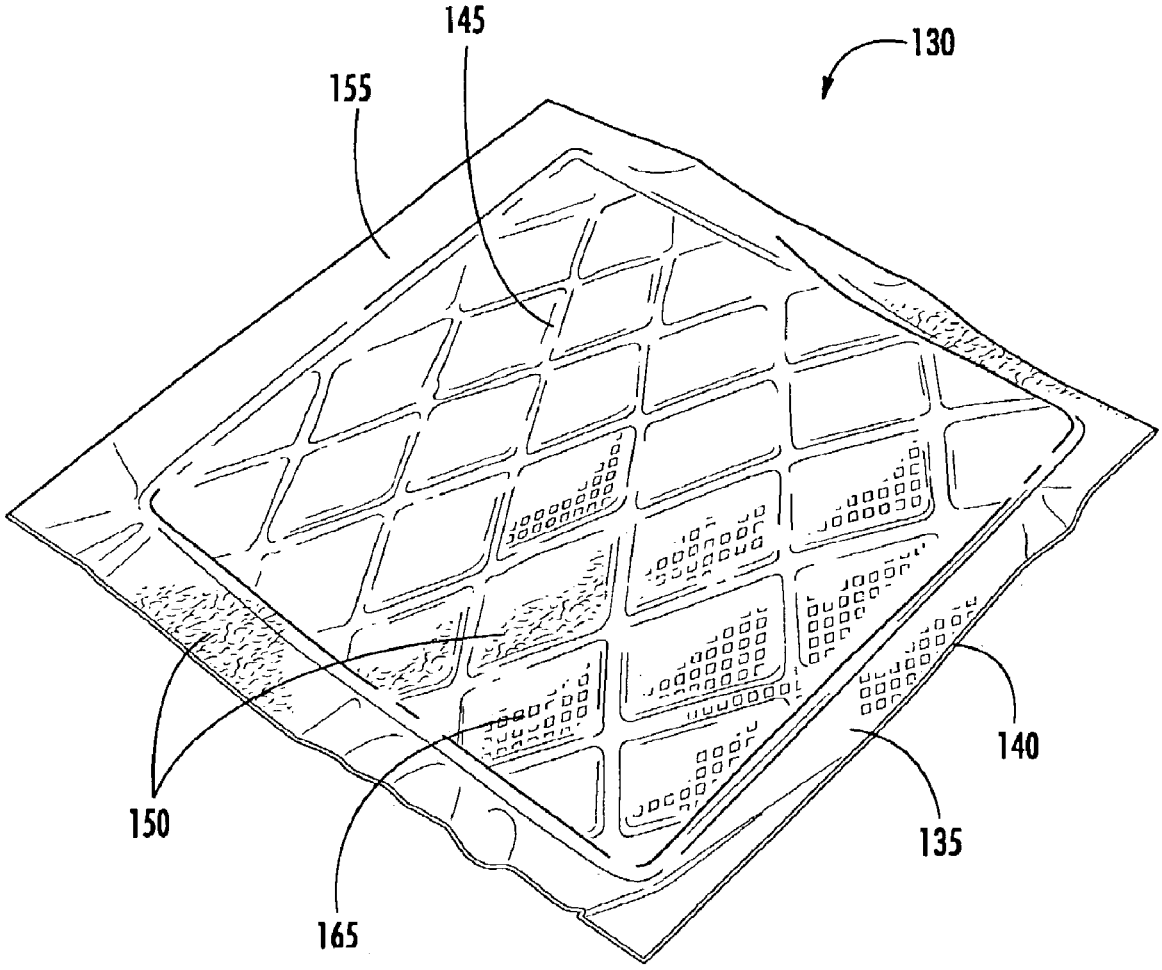
Figure 5:
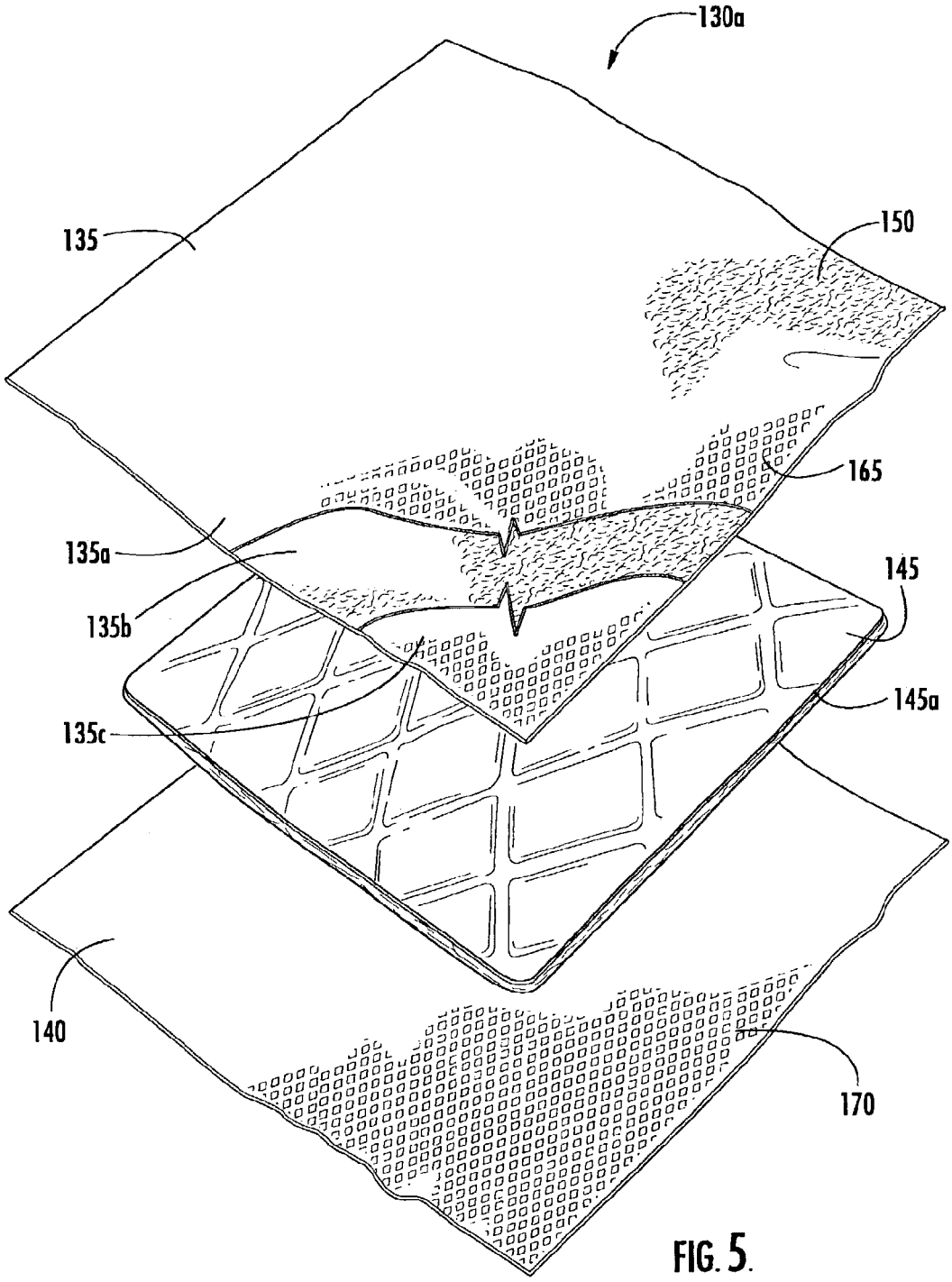
Figure 6:
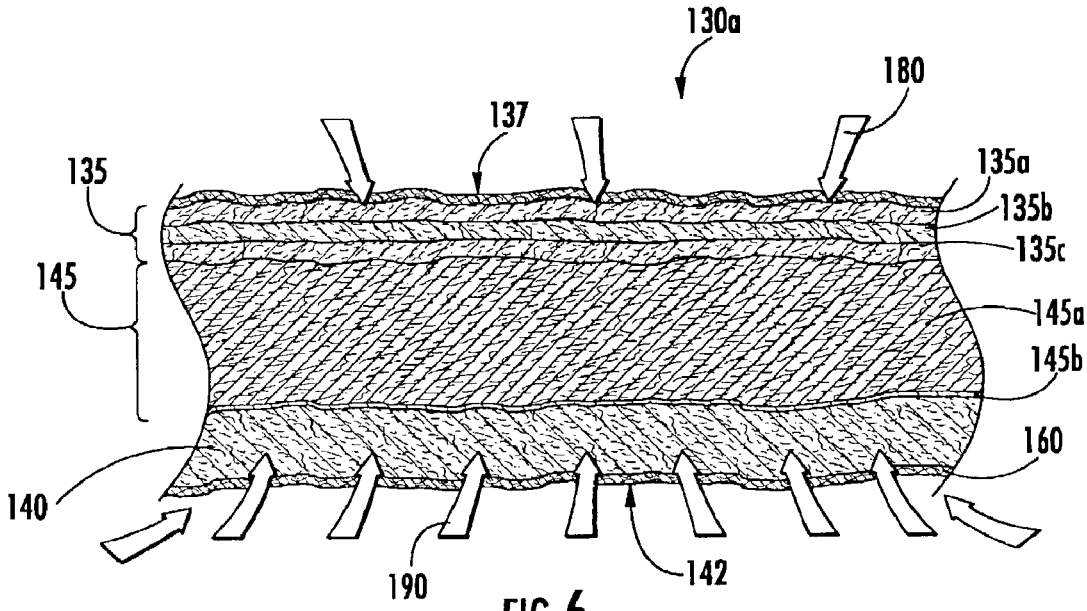
Figure 7:
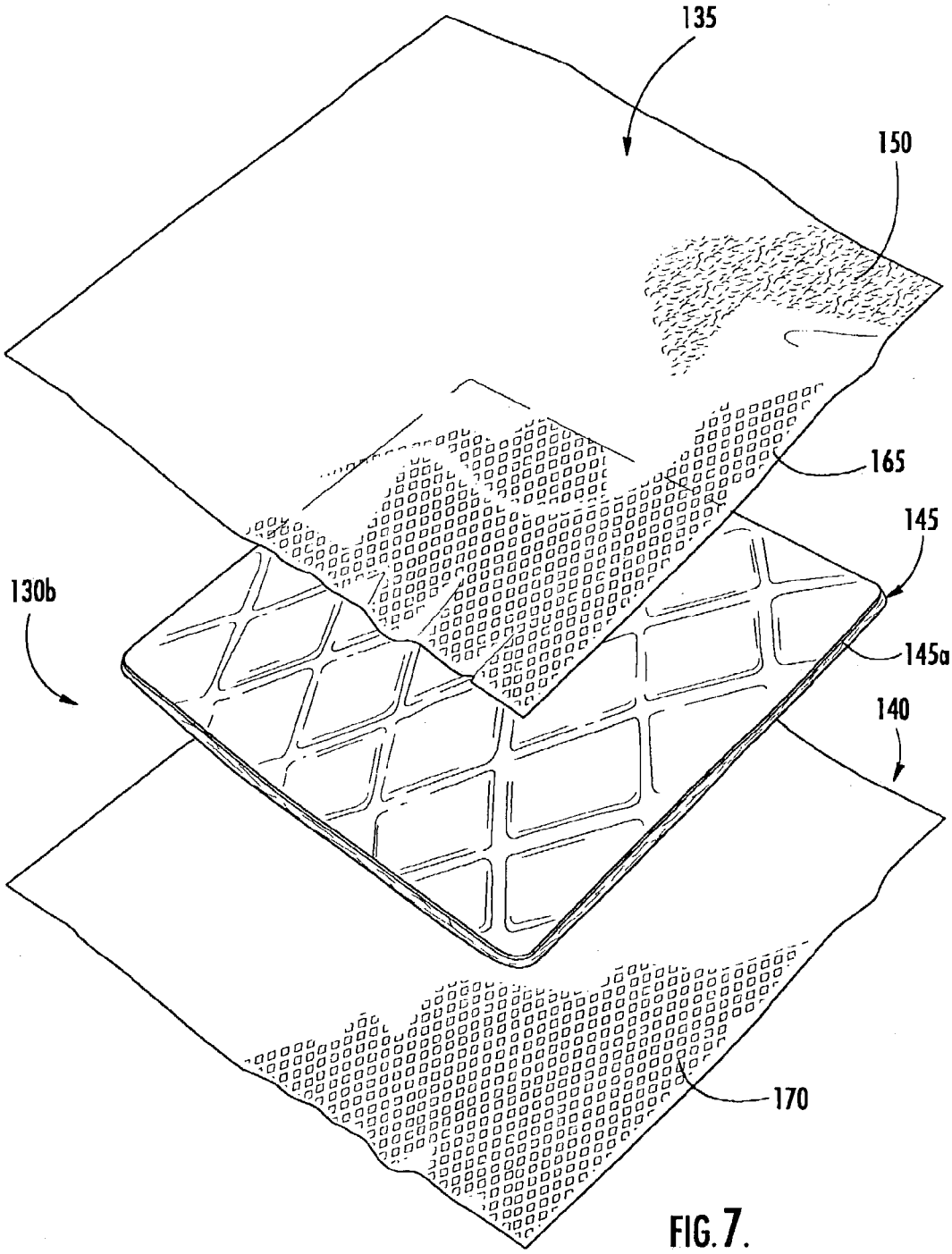
Figure 8:
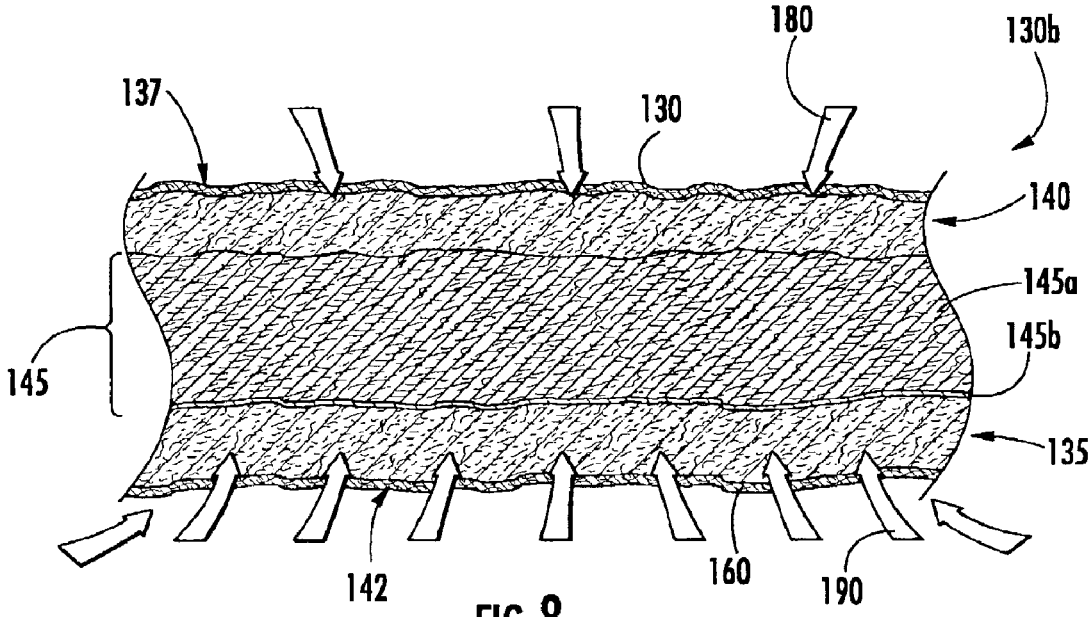
Figure 9:
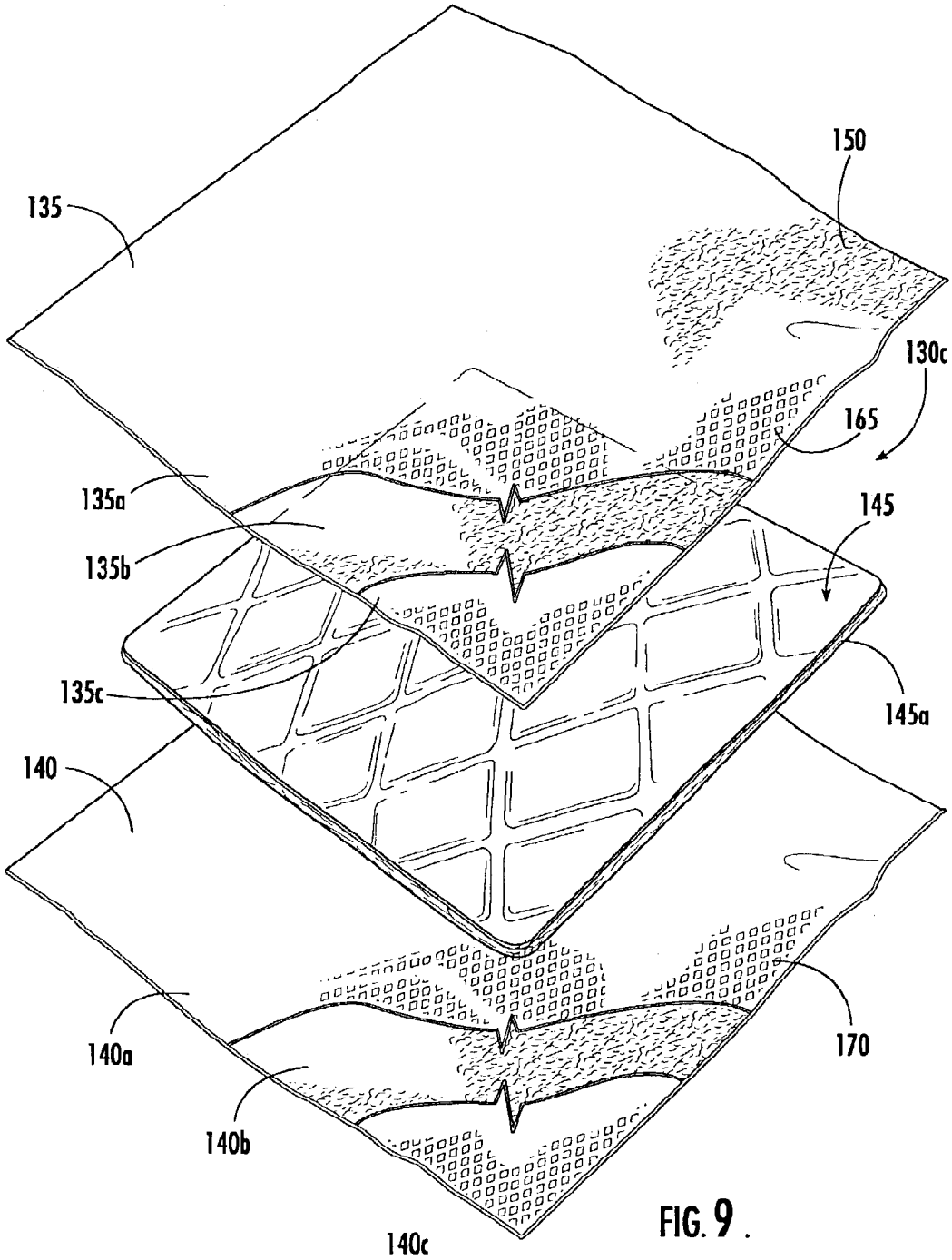
Figure 10:
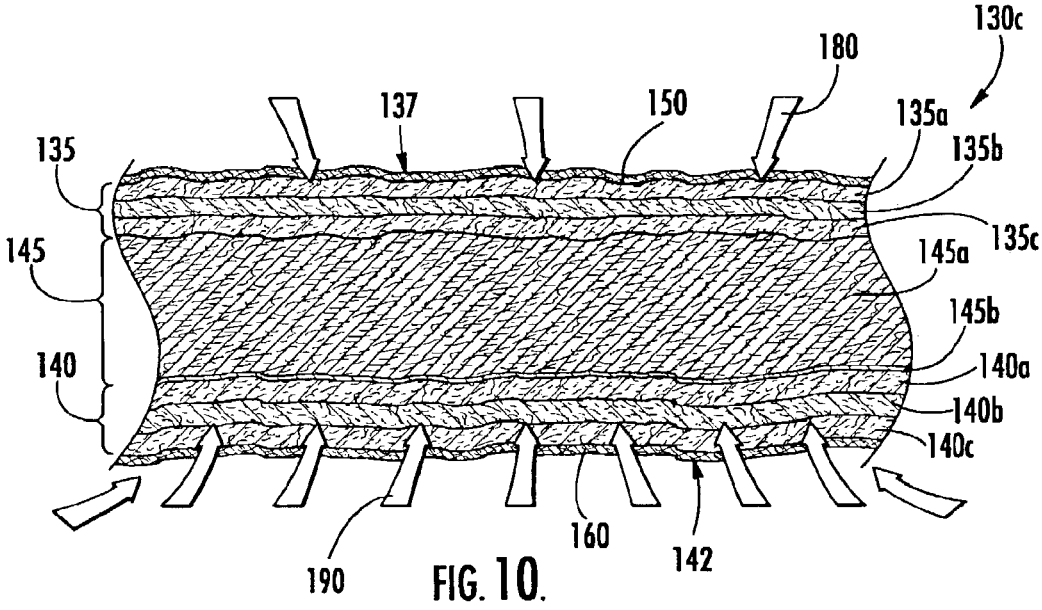

Having thus described the invention in general terms, reference will now be made to the accompanying drawings, which are not necessarily drawn to scale, and wherein:

FIG. 1 is a perspective view of a food package embodying the features of the present invention;

FIG. 2 is a perspective view of a food package illustrating a preferred embodiment of the present invention;

FIG. 3 is a perspective view of a packaging tray containing the absorbent pad embodying the features of the present invention;

FIG. 4 is a perspective view of the absorbent pad embodying the features of the present invention;

FIG. 5 is an exploded perspective view of the absorbent pad shown in FIG. 4 having a SMS upper layer and spunbonded lower layer;

FIG. 6 is an enlarged fragmentary sectional side view of the absorbent pad shown in FIG. 5;

FIG. 7 is an exploded perspective view of the absorbent pad shown in FIG. 4 having a spunbonded upper layer and spunbonded lower layer;

FIG. 8 is an enlarged fragmentary sectional side view of the absorbent pad shown in FIG. 7;

FIG. 9 is an exploded perspective view of the absorbent pad shown in FIG. 4 having a SMS upper layer and SMS lower layer;

FIG. 10 is an enlarged fragmentary sectional side view of the absorbent pad shown in FIG. 9.

DETAILED DESCRIPTION OF THE INVENTION

The invention will now be described more fully hereinafter with reference to the accompanying drawings, in which the preferred embodiments are shown. This invention may however, be embodied in many different forms and should not be construed as limited to the embodiments set forth herein; rather these embodiments are provided so that this disclosure will be thorough and complete, and will convey the scope of the invention to those skilled in the art. Like numbers refer to like elements throughout.

Referring more specifically to the drawings, for purposes of illustration, but not of limitation, there is shown in FIG. 1 one form of the case-ready food package 95 embodying the features of the invention in a package for cut-up chicken. With reference to FIG. 2, reference number 100 broadly designates an embodiment of the invention of a package for a whole chicken. As illustrated, chicken package 95, 100 includes an absorbent pad 130, a tray 110, also termed a support member, a lid member 120, and the poultry 105, 105*a*. Absorbent pad 130 rests on the bottom of the tray 110 and is adapted to receive the poultry 105, 105*a* thereon. The absorbent pad 130 will therefore support the food product 105, 105*a* thereon and is adapted to absorb liquids in the form of juices, water, or the like that are exuded by the food product 105, 105*a*. Absorbent pad 130 is adapted to absorb liquids at a controlled rate of wicking that will not result in desiccating the food product 105, 105*a*. This is especially advantageous in regards to poultry products. Poultry contains a large volume of liquids, and thus requires a pad with superior absorptive abilities.

With reference to FIGS. 4 through 10, an absorbent pad 130 of the invention is illustrated. As illustrated in FIG. 3, the absorbent pad 130 is preferably placed flat on the bottom of the tray 110*a*. The absorbent pad 130 comprises an upper layer 135, a lower layer 140, and an absorbent intermediate layer 145. As illustrated in FIGS. 4 through 10, upper layer 135 and lower layer 140 are highly permeable to water and air, and can be woven, knitted, etc., and are preferably a nonwoven fibrous web. The nonwoven web is typically comprised of continuous filaments that are bonded to form a coherent web. Staple length fibers, including meltblown fibers can also be used, although not necessarily with equivalent results. The fiber can be any thermoplastic or thermosetting polymer, and normally the fiber comprises a polyolefin, polyester, or polyamide. Typically, the upper layer 135 and lower layer 140 contain fiber made from a hydrophobic polymer such as polypropylene, polyethylene, or polyester.

In a preferred embodiment, broadly designated by reference number 130*a*, the nonwoven upper layer 135 is of a spunbonded/meltblown/spunbonded trilaminate construction (SMS) in which a layer of substantially discontinuous meltblown polymeric fibers 135*b* is sandwiched between layers 135*a*, 135*c* of substantially continuous spunbonded polymeric filaments (FIG. 6). The substantially continuous polymeric spunbond filaments and the substantially discontinuous meltblown polymeric fibers can be prepared from a wide variety of thermoplastic polymers. Polypropylene or polyethylene terephthalate polymer is often used to prepare meltblown fibers and spunbonded filaments. SMS webs include Avgol® nonwoven polypropylene, obtainable from John Cleaver Associates of Aaoli, Pa., BBA® nonwoven polypropylene, obtainable from BBA of Simpsonville, S.C., and other SMS webs available from various suppliers.

With reference to FIGS. 5 and 6, an absorbent pad 130*a* having a SMS upper layer and a spunbonded nonwoven lower layer is illustrated. SMS fabrics provide an increased barrier to liquid ingress than a spunbonded nonwoven, and therefore the top surface 137 of the upper layer 135 is necessarily coated with a hydrophilic surfactant 150 so that liquid exudates are pulled off the surface of the upper layer and absorbed into the intermediate absorbent layer 145. The hydrophilic coating 150 wicks liquids off the surface 137 and into the upper layer 135, thereafter the liquids travel by capillary action through the upper layer 135 and into the absorbent layer 145. In this manner, the upper layer only wicks liquids that are present on its surface 137, and does not result in drying out the food product.

The lower layer 140 is a nonwoven fibrous web and is also coated with a hydrophilic surfactant 160. Nonwoven webs for the lower layer 140 include Reemay® spunbonded polyester (polyethylene terephthalate), Typar® nonwoven spunbonded polypropylene (also known as Tekton® nonwoven spunbonded polypropylene), both of which are available from Reemay, Inc. of Old Hickory, Tenn. Other nonwoven webs include Avgol® nonwoven polypropylene, obtainable from John Cleaver Associates of Aaoli, Pa., and BBA® nonwoven polypropylene, obtainable from BBA of Simpsonville, S.C.

In a second embodiment, broadly designated by reference number 130*b*, both the upper layer 135 and lower layer 140 are a spunbonded nonwoven web, and are normally made of the nonwoven webs discussed above. With this regard, FIGS. 7 and 8 illustrate an absorbent pad having a nonwoven upper layer 135 and lower layer 140. The upper layer 135 and the lower layer 140 may be made from the same material, or alternatively, upper layer 135 could comprise a different nonwoven material than lower layer 140.

In a third embodiment, broadly designated by reference number 130*c*, both the upper layer 135 and lower layer 140 are made of a SMS construction. With reference to FIGS. 9 and 10 an absorbent pad 130*c* having a SMS upper and lower layer 135, 140 is illustrated. Both layers are coated with hydrophilic surfactants 150, 160. Similar to the SMS upper layer in the first embodiment (FIG. 6), liquids are wicked into the layers 135, 140 by the hydrophilic coatings 150, 160, and thereafter are transported into the absorbent layer by capillary action. Having a SMS upper and lower layer 135, 140 provides for the slowest rate of wicking and may be ideal for applications where a food product could be easily dried out by excessive wicking.

With reference to FIGS. 5–10, a hydrophilic coating 150 is illustrated on the food-facing surface of the upper layer 135. FIGS. 6, 8, and 10 illustrate a hydrophilic coating 160 on the tray-facing surface 142 of lower layer 140. The hydrophilic coatings 150, 160 enable controlled strike through by liquid exudates to the intermediate absorbent layer 145. Varying the amount of hydrophilic coatings 150, 160 on the upper and lower layers 135, 140 changes the hydrophobic/hydrophilic balance of the upper and lower layers 135, 140, and thereby controls the absorbent pad's rate of wicking. The absorbent pad 130 may therefore be customized to different types of food products depending upon the characteristics of the food products and particularly the type and/or volume of exudates therefrom. For example, poultry will normally exude significantly more liquids than a beef or pork product, and may therefore require an absorbent pad having a greater amount of wicking. Thus, an absorbent pad specifically adapted for poultry normally has a greater amounts of hydrophilic coatings on both its upper and lower layers than does an absorbent pad adapted for a beef product.

In all embodiments, less hydrophilic coating is applied to the upper layer than to the lower layer. Applying less hydrophilic coating 150 on the upper layer 135 increases the hydrophobic character of the nonwoven, and will therefore result in decreasing the rate at which the upper layer 135 wicks liquids. Applying a greater amount of hydrophilic coating on the lower layer 140 than is present on the upper layer 135 ensures that adequate wicking is maintained by the absorbent pad 130.

In this regard, there is illustrated in FIGS. 6, 8, and 10 a cross-sectional view of an absorbent pad 130 having a greater amount of hydrophilic coating 160 on the lower layer 140 than the amount of hydrophilic coating 150 that is present on the upper layer 135. The arrows 180 and 190 represent liquids entering into the absorbent pad 130. This illustrates that the lower layer 140 with the greater amount of hydrophilic coating 160 has a greater rate of wicking than the upper layer 135. Thus, the amount of hydrophilic coating 150 that is present on the upper layer 135 can be adjusted to pre-select the rate of wicking on the top surface 137 and to ensure that the food product 105, 105*a* is not dried out by excessive wicking of the upper layer.

In this manner, an absorbent pad having a SMS upper layer and a spunbonded nonwoven lower layer (FIGS. 5 and 6) has features that are most advantageous. The SMS layer naturally acts as a moisture barrier and it is only through the addition of a hydrophilic coating that liquids are absorbed into the absorbent layer, whereas, the lower layer, being liquid-permeable and coated with a hydrophilic surfactant will independently absorb large quantities of exudates. This combination creates an absorbent pad that has an upper layer that has a rate of wicking that is independently adjusted with respect to the lower layer, and a lower layer that has a high rate of wicking.

The hydrophilic coatings 150, 160 applied to the upper and lower layers 135, 140 that impart hydrophilicity to the layers are typically a cationic, anionic, nonionic or amphoteric surfactant. Normally, the hydrophilic coating is a nonionic surfactant such as alkylphenol ethoxylates, alkylphenyl polyethylene glycol ethers (including alkylaryl polyether alcohol, polyethylene glycol mono-(4-octylphenyl) ether, polyethylene glycol mono-(4-tert-octylphenyl) ether, polyoxyethylated octylphenol, ethoxylated octylphenol, octylphenol ethyleneoxide$_x$ where X stands for the average units of ethylene oxide). The surfactant will have a range of ethylene oxide units from 1 to 40 with a calculated Hydrophilic/Lipophilic Balance ("HLB") of 2 to 20. HLB is an arbitrary scale from 0 to 40 depicting the hydrophilic/lipophilic balance of a surfactant. Examples of the hydrophilic coating include TRITON X-35™, X-45™, X-100™, X-102™, X-405™ from Dow Chemical Co., OTIX 3, 10, and 40™ from Sasol Chemical Industries of Bad Homberg, Germany, and Polystep OP-9™, OP-3070™, and OP-4070™ from Stepan Co. of Northfield, Ill.

Additional sources of nonionic surfactants include combinations of ethers of phenol, polyethylene glycol, alkylphenol, and polypropylene glycol, polysorbates, fatty amine oxides, linear alcohol ethoxylates, alkanolamides, and block copolymers of ethylene oxide and propylene oxide and dimethylsiloxane based that are coupled to polar groups such as poly(oxethylene) containing the hydrophilic moiety, and mixtures thereof. Although any hydrophilic composition could be used, preferred compositions include Cirracol® PP842 fiber finish, obtainable from Uniquema. All the components in Cirracol® PP842 can be used in applications where direct food contact is desired. However, the hydrophilic coatings are not limited to above recited surfactants and any surfactant may be substituted provided that it adheres to the upper and lower layers, is food-grade compatible, and imparts hydrophilicity thereto.

The hydrophilic coating 160 may be advantageously applied to the lower layer 140 in an amount of from about 0.05 to 10 percent based on the weight of the nonwoven lower layer 140. Typically, the coating is applied in an amount from about 0.1 to 2.0 weight percent. Somewhat more typically, the coating is applied in an amount from about 0.5 to 1.0 percent. The hydrophilic coating 150 applied to the upper layer 150 is preferably in an amount from about 0.0 to 1.0 percent based on the weight of the nonwoven upper layer 135. Typically, the coating is applied in an amount from about 0.01 to 0.75 percent. Somewhat more typically, the coating is applied in an amount from about 0.01 to 0.35 percent. It should be understood that the present invention is not limited to the proportions and percentages of hydrophilic coatings recited above and that other percentages or proportions of hydrophilic coatings may be used depending upon the desired rate of wicking that is sought.

Additionally, changing the basis weight (permeability) of the upper and lower layers 135, 140 can control the absorbent pad's 130 rate of wicking. In this regard, FIG. 6 also illustrates that the nonwoven spunbonded lower layer 140 wicks at a greater rate than the SMS upper layer 135. The balance of properties desirable in the SMS of the invention is related to the basis weight of the individual webs used in the fabric and to the overall weight of the fabric. The SMS will have an overall basis weight between 6 to 20 gsm, more typically, from about 11 to 15 gsm, and somewhat more typically between 11 and 14 gsm. With respect to embodiments 130*a* and 130*b*, the spunbonded nonwoven layers will have an overall basis weight of 1 to 25 gsm, more typically, from about 5 to 20 gsm, and somewhat more typically between 10 and 15 gsm.

With reference to FIG. 5, 7, and 9 the permeability of the upper layer 135 and lower layer 140 is broadly illustrated, without limitation, by the openings in the webs at 165 and 170. Increasing the permeability of a layer increases that layer's rate of wicking. With reference to FIG. 7, the upper layer 135 nonwoven and the lower layer 140 nonwoven webs can be chosen independently with respect to each other, so that one layer has a greater permeability than the other layer. This will allow one skilled in the art to choose a material for the upper layer and lower layer depending upon the desired rate of wicking for each layer. The openings 165 and 170 are merely illustrative of the permeability of the upper and lower layers and the actual size of the openings (permeability) in the layers will be dependent upon the basis weights of the web and the manufacturing process. As will be apparent to one skilled in the art, the permeability of the layers and the amount of hydrophilic coating applied thereto are independently controlled so that one skilled in the art can manipulate both factors to create an absorbent pad having the desired rate of wicking.

Intermediate absorbent layer 145 is disposed between and enveloped by upper layer 135 and lower layer 140 and the layers 135, 140 extend beyond the periphery of the intermediate absorbent layer 145 and are sealed together as illustrated at 155 (FIG. 4).

Intermediate layer 145 comprises a mat of absorbent fibers 145*a*, such as several layers of absorbent tissue or a relatively thick layer of wood fluff, which are relatively inexpensive and highly absorbent. When wood fluff is used, it is desirable to isolate the very short wood fluff fibers in the mat from the permeable lower layer 140. A layer of tissue 145*b* is therefore placed between the mat and the permeable lower 140 layers, to act as a mechanical barrier between the upper 135 and lower 140 layers and the short wood fluff fibers. The tissue layer may be any suitable layer of tissue paper, such as that commonly referred to as facial grade tissue or wet strength tissue.

The absorbent layer 145 can further comprise a component which is a superabsorbent, present in the form of fibers, granules, or any other suitable form. Typically, the absorbent layer 145 will be between 0 to 1% SAP by weight. Some chemical compounds that have been found particularly effective as superabsorbents include a carboxyl-methylcellulose superabsorbent compound and an acrylic superabsorbent (acrylic acid and sodium acrylate copolymer compound). Both of these chemical compounds are USDA/FDA approved or approvable chemical compounds that can be used in connection with processed meat products. Other superabsorbent chemical compounds can also be used in the absorbent layer, as desired. Superabsorbent fiber having a length of about 3 mm is available under the OASIS™ from Technical Absorbents Ltd., as disclosed in UK Patent Application 2325195, published Nov. 18, 1998, entitled "Absorbent Pad." Preferred superabsorbent granules are Favor PAC™ 100, obtained from Stockhausen, of Greensboro, N.C. These granules have a particle size of 100 to 850 microns, and are preferably in the pad in an amount of from about 0.1 to 50 weight percent, and even more preferably from about 1 to 30 weight percent. However, the absorbent intermediate layer is not limited to the use of a combination of woodfluff and tissue paper or a superabsorbent and other materials, such as fluffed cellulose pulp, cellulose tissue, cotton ball, thermoplastic or thermoset foams, continuous superabsorbent fibers, a highly hydrophilic nonwoven fabric, or a meltblown layer, may be substituted for such, provided that the ability to absorb liquids exuded by the food product is maintained.

A second aspect of the present invention is the enhanced seal strength that results from bonding a nonwoven upper layer 135 directly to a nonwoven lower layer 140. Having two nonwovens bonded directly to each other creates a seal that is more resistant to rupturing. The upper layer 135 can be directly attached to the lower layer 140 with a heat seal. The upper and lower layers 135, 140 are attached to one another around their perimeter using an adhesive, typically a hot melt adhesive (e.g., melting at 200° F. to 400° F.), or a liquid adhesive.

One such adhesive is a semi-pressure-sensitive adhesive based on a polymeric component mixed with tackifier and wax. A primary polymeric component is an aromatically-modified $C_5$ petroleum hydrocarbon resin, such as Wingtack® 86, made by Goodyear Tire and Rubber Co., which can make up 40 to 55 percent of the total weight of the adhesive. The secondary polymeric component of the adhesive is normally an amorphous polymerized alpha-olefin such as a propylene polymer. A particularly preferred secondary polymeric component is RT2304 1-propene polymer with ethane (present in an amount of from 25 to 35 percent), made by Huntsman Corp. of Salt Lake City, Utah. Alternatively, the secondary polymeric component can be RT2315 (present in an amount of from 25 to 35 percent), also from Huntsman. Indopol® H300 isobutylene/butene copolymer, obtained form Amoco Corp., is a preferred tackifier, it being present at a level of from 1 to 5 percent. Irganox® 1010, obtained from Ciba-Geigy, of McIntosh, Ala., it being present at a level of from 0.01 to 0.5 percent. A blend of the above polymeric components, tackifier, and antioxidants was obtained from Henkel Adhesives of Lewisville, Tex., as well as from National Starch and Chemical of Bridgewater, N.J.

As will be apparent to one of skill in the art, the dimensions of the absorbent pad 130 can be modified depending upon the size and quantity of food that is packaged in the case-ready package 100, 95. For example, the invention is particularly suited for packaging of poultry. Poultry can be purchased in a grocery store in a variety of different cuts and proportions. A 5 lb. package of poultry will therefore require a larger absorbent pad than would be needed for a 2 lb. package of poultry. Preferably, an absorbent pad accommodating a family-size package of poultry (approximately 5 lbs.) will have about 12.7"×7.5". The absorbent pad will preferably be between 2 to 3 mm thick prior to absorbing exudates.

A second embodiment of the present invention, directed to a case-ready package is illustrated in FIGS. 1 and 2 and is broadly designated by reference number 95 and 100 respectively. Typically, a case-ready package is a package in which the food product has been processed, packaged, and shipped from a single origination point to the retailer for immediate display and sale. The case-ready package 95, 100 comprises a tray 110 (also referred to as a support member), a food product 105, 105*a*, a lid member 120, and the absorbent pad 130 as discussed above.

As shown in FIG. 3, tray 110 comprises a bottom wall 110*a*, side walls 110*b*, end walls 110*c* integrally formed to provide a receptacle for receiving and containing therein a food product 105, 105*a* (FIGS. 1 and 2), and an (optional, but preferred) horizontal flange 115 projecting outward from the top edge of the side and end walls 110*b*, 110*c*. Tray 110 is preferably made from conventional foamed materials such as polystyrene, polypropylene, polyester, and the like. Additional suitable materials from which the tray 110 can be formed include, without limitation, polyvinyl chloride, polyethylene terephthalate, polyolefins such as high-density polyethylene or polypropylene, paper pulp, nylon, polyurethane, etc. While preferred, tray 110 is by no means the only type or form of container for the food product. Such containers may be in any form currently employed in packaging food products for display, storage etc. For example, it is well known that food products may be packaged in plastic film bags, molded fibrous trays, or paperboard boxes.

The tray 110 can have any desired configuration or shape, e.g., rectangular, round, oval, etc. Similarly, a flange 115 on the tray may have any desired shape or design including a simple, substantially flat design as shown, or a more elaborate design such as, e.g., those disclosed in U.S. Pat. Nos. 5,348,752 and 5,439,132, the disclosures of which are hereby incorporated in their entireties, by reference thereto. Alternatively, the tray may be in the form of a substantially flat sheet.

The lid member 120 is preferably made from a flexible and transparent film. Suitable materials for the cover member include, without limitation, polyester, polyethylene, terephalate, nylon, polypropylene, high density polyethylene, or release coated papers such as cellophane, silicone, coated paper or quilon-coated paper. The cover member can be secured to tray 110 by attaching it with a heat seal or adhesive. Preferably, the lid member 120 is sealed to the tray 110 at the horizontal flange 115. Alternatively, the lid member 120 can be wrapped under bottom of the tray 110*a* along the entire perimeter of the tray and adhesively bonded or heat-sealed to itself or the bottom of the tray.

In a preferred embodiment, the lid member 120 is made from a flexible film having two separate layers (an upper film and a lower film) that are peelably separable from each other. The film is placed on the case-ready package 100, 95 during the packaging process following atmosphere evacuation within the package 100, 95. The upper film is substantially gas impermeable whereas the lower film is gas-permeable. In this manner, a product can be packaged and shipped under a vacuum or modified atmosphere that will maximize the product's shelf-life. At the point of sale, the retailer removes the upper gas-impereable film and the food product is subsequently exposed to the atmosphere which causes the fresh red meat, poultry, and pork to bloom, while the product remains in the original package 100, 95. Preferred examples of multiplayer, coextruded films that are suitable for a film in accordance with the present invention are described in U.S. Pat. No. 5,770,287 (Miranda et al.).

In vacuum skin packaging the film is thermoformable, i.e., capable of being formed into a desired shape upon the application of heat, and is thermoformed about the product on the support member by means of heat and differential pressure. Virtually all of the air is evacuated from the interior of the package so that the film conforms very closely to the contour of the packaged product. Generally, sufficient heat is applied to cause the film to bond with the support member outside the periphery of the product, either by employing a heat activated adhesive at the interface of the film and support member or by forming the film and support member from materials that are otherwise sealingly compatible upon the application of heat, e.g., by employing similar polymeric materials, such as polyethylenes, at the seal interface that bond to one another when heated. Alternatively, a pressure sensitive adhesive can be used. Further details are described in, e.g., U.S. Pat. No. Re 30,009 (Purdue et al.), U.S. Pat. No. 5,346,735 (Logan et al.), and U.S. Pat. No. 5,770,287 (Miranda et al.), the disclosures of which are hereby incorporated in their entireties by reference.

In modified-atmosphere packaging, a food product is generally packaged in a tray-like support member having a peripheral flange to which the film is secured. Prior to securing the film to the support member, air is generally evacuated from the interior of the support member and replaced by a gas which extends the shelf-life of the packaged product.

The food product 105, 105*a* may be any type of meat, poultry, or produce. Preferably, the food product 105, 105*a* is poultry. The absorbent pad of the present invention is especially suited for products containing high volumes of liquids that will be exuded between the time of packaging and point of sale. With reference to FIGS. 1 and 2, a food product 105, 105*a* is illustrated. FIG. 1 illustrates a preferred embodiment of the case-ready packaging 95. FIG. 2 depicts an entire chicken being packaged with a large proportion of the chicken extending upwardly beyond the top of the tray's sidewalls 110*b*. Preferably, the food product 105, as depicted in FIG. 1, is processed chicken parts, such as breasts, thighs, drumsticks, etc. However, the case-ready package 95, 100 is not limited to the above recited food products, and as such, any food can be packaged therein.

The attached Table 1 shows five absorbent pads prepared in accordance with the invention. Absorbent pads 1 through 5 are constructed of a SMS upper layer and a spunbonded (SB) lower layer. Absorbent pad #1 has no surfactant applied to the upper layer and 0.6 percent surfactant applied to the lower layer based on the weight of the lower layer. Absorbent pad #2 has 0.2 percent surfactant applied to the SMS layer and 0.6 percent surfactant applied to the SB layer based on the weight of each respective layer. Similarly, pad #3 has 1.0 percent applied to the SMS and 0.6 percent applied to the SB; pad #4 has 0.2 percent applied to the SMS and 1.0 percent applied to the SB; and pad #5 had 1.0 percent applied to the SMS layer and 1.0 percent applied to the SB layer.

Table 2 is a measure of the each pad's absorptive capabilities as a function of time. Each pad was dipped vertically into a saline solution that is dyed red. A picture of each pad is taken at the time intervals listed below, and the area of the pad that is red is divided by the total area of the pad. The resulting ratios are the percent rate of wicking as a function of time.

TABLE 1

| Absorbent Pad | Upper layer material | Amount of Surfactant present on upper layer (%) | Lower layer material | Amount of surfactant present on lower layer (%) |
|---|---|---|---|---|
| Pad # 1 | SMS* | 0.0 | SB* | 0.6 |
| Pad # 2 | SMS | 0.2 | SB | 0.6 |
| Pad # 3 | SMS | 1.0 | SB | 0.6 |
| Pad # 4 | SMS | 0.2 | SB | 1.0 |
| Pad # 5 | SMS | 1.0 | SB | 1.0 |

SMS* = spunbonded/meltblown/spunbonded;
SB* = spunbonded

TABLE 2

| Absorbent Pad | Wicking at 5 min. | Wicking at 10 min. | Wicking at 15 min. | Wicking at 20 min. | Wicking at 30 min. | Wicking at 45 min. | Wicking at 60 min. | Wicking at 120 min. |
|---|---|---|---|---|---|---|---|---|
| Pad # 1 | 0 | 0 | 0 | 0 | 0 | 0 | 0 | 0 |
| Pad # 2 | 3.81 | 12.91 | 29.07 | 44.83 | 60.18 | — | 70 | 97 |
| Pad # 3 | 17.12 | 29.6 | 41.13 | 41.13 | 75.69 | — | 85 | 100 |
| Pad # 4 | 13.18 | 30 | 40 | 40 | — | 80 | 97 | 100 |
| Pad # 5 | 20 | 40 | 46 | 46 | — | 96 | 99 | 100 |

As can be seen from Table 2, the area saturated increases as a function of time and in proportion to the amount of hydrophilic coating that is applied to each layer. In this regard, it can be seen that pad #2, which embodies the preferred features of the invention, has close to 100 percent saturation after 120 minutes.

Many modifications and other embodiments of the invention will come to mind to one skilled in the art to which this invention pertains having the benefit of the teachings presented in the foregoing descriptions and associated drawings. Therefore, it is to be understood that the invention is not limited to the specific embodiments disclosed and that modifications and other embodiments are intended to be included within the scope of the appended claims. Although specific terms are employed herein, they are used in a generic and descriptive sense only and not for the purposes of limitation.

What is claimed is:

1. An absorbent pad comprising: a liquid-permeable upper layer, a liquid-permeable lower layer, and an absorbent layer disposed between said upper and lower layers, wherein said upper and lower layers extend outwardly beyond the periphery of said intermediate layer, and said upper layer and said lower layer are attached directly to one another around the entire perimeter of said intermediate layer, such that said intermediate absorbent layer is confined within the bounds of said upper and said lower layers, said upper and lower layers comprising nonwoven fibrous webs having hydrophilic composition coated thereon, and wherein said lower layer has a greater amount of hydrophilic composition coated thereon than said upper layer.

2. An absorbent pad according to claim 1, wherein said upper and lower layer hydrophilic compositions are independently selected from the group consisting of alkylphenol ethoxylates, alkylphenyl polyethylene glycol ethers (including alkylaryl polyether alcohol, polyethylene glycol mono-(4-octylphenyl) ether, polyethylene glycol mono-(4-tertoctylphenyl) ether, polyoxyethylated octylphenol, ethoxylated octylphenol, octylphenol ethyleneoxide$_x$ where X stands for the average units of ethylene oxide), polyethylene glycol, alkylphenol, polypropylene glycol, polysorbates, fatty amine oxides, linear alcohol ethoxylates, alkanolamides, block copolymers of ethylene oxide and propylene oxide, and mixture thereof.

3. An absorbent pad according to claim 1 wherein said lower layer absorbs liquid at a rate greater than said upper layer.

4. An absorbent pad according to claim 1, wherein said upper layer nonwoven is a spunbonded/meltblown/spunbonded trilaminate construction.

5. An absorbent pad according to claim 4, wherein said upper layer nonwoven is selected from the group consisting of polyolefin, polyester, polypropylene, and polyamide thermoplastic fibers.

6. An absorbent pad according to claim 1, wherein said intermediate absorbent layer comprises a superabsorbent.

7. An absorbent pad according to claim 6, wherein at least some of the superabsorbent is present in granular form.

8. An absorbent pad according to claim 1, wherein said intermediate absorbent layer comprises a layer of wood fluff and a layer of tissue paper.

9. An absorbent pad according to claim 8, wherein said intermediate absorbent layer further comprises a superabsorbent.

10. An absorbent pad according to claim 1, wherein said upper layer is attached to said lower layer with an adhesive.

11. An absorbent pad according to claim 1, wherein said upper layer is attached to said lower layer with a heat seal.

12. An absorbent pad comprising: a liquid-permeable upper layer, a liquid-permeable lower layer, and an absorbent layer disposed between said upper and lower layers, wherein said upper and lower layers extend outwardly beyond the periphery of said intermediate layer, and said upper layer and said lower layer are attached directly to one another around the entire perimeter of said intermediate layer, such that said intermediate absorbent layer is confined within the bounds of said upper and said lower layers, said upper and lower layers comprising nonwoven fibrous webs having hydrophilic composition coated thereon, said lower layer having a greater amount of hydrophilic composition coated thereon than said upper layer, and wherein said lower layer nonwoven is selected from the group consisting of polyolefin, polyester, polypropylene, and polyamide.

13. An absorbent pad according to claim 12, wherein said upper layer hydrophilic composition is present on said upper layer in an amount from 0.05 to 1.0 percent based on the weight of said upper layer.

14. An absorbent pad according to claim 12, wherein said lower layer hydrophilic composition is present on said lower layer in an amount from 0.05 to 10 percent based on the weight of said lower layer.

15. An absorbent pad according to claim 12, wherein said lower layer hydrophilic composition is present on said lower layer in an amount from 0.5 to 1 percent based on the weight of said lower layer and said upper layer hydrophilic composition is present on said upper layer in an amount from 0.1 to 0.35 percent based on the weight of said upper layer.

16. An absorbent pad comprising: a liquid-permeable upper layer, a liquid-permeable lower layer, and an absorbent layer disposed between said upper and lower layers, wherein said upper and lower layers extend outwardly beyond the periphery of said intermediate layer, and said upper layer and said lower layer are attached directly to one another around the entire perimeter of said intermediate layer, such that said intermediate absorbent layer is confined within the bounds of said upper and said lower layers, said upper and lower layers comprising a spunbonded/meltblown/spunbonded trilaminate construction having hydrophilic composition coated thereon.

17. An absorbent pad according to claim 16, wherein said lower layer has a greater amount of hydrophilic composition coated thereon than said upper layer.

18. An absorbent pad comprising: a liquid-permeable upper layer, a liquid-permeable lower layer, and an absorbent layer disposed between said upper and lower layers, wherein said upper and lower layers extend outwardly beyond the periphery of said intermediate layer, and said upper layer and said lower layer are attached directly to one another around the entire perimeter of said intermediate layer, such that said intermediate absorbent layer is confined within the bounds of said upper and said lower layers, said upper layer comprises a spunbonded/meltblown/spunbonded trilaminate construction having hydrophilic composition coated thereon, and said lower layer comprises a nonwoven fibrous web having hydrophilic composition coated thereon, and wherein said lower layer has a greater amount of said hydrophilic composition coated thereon than said upper layer.

19. An absorbent pad according to claim 18, wherein said lower layer wicks liquids at a greater rate than said upper layer.

20. An absorbent pad according to claim 18, wherein said intermediate absorbent layer comprises a superabsorbent.

21. An absorbent pad according to claim 20, wherein at least some of the superabsorbent is present in granular form.

22. An absorbent pad according to claim 18, wherein said intermediate absorbent layer comprises a layer of wood fluff and a layer of tissue paper.

23. An absorbent pad according to claim 22, wherein said intermediate absorbent layer further comprises a superabsorbent.

24. An absorbent pad according to claim 18, wherein said upper layer is attached to said lower layer with an adhesive.

25. An absorbent pad according to claim 18, wherein said upper layer is attached to said lower layer with a heat seal.

26. An absorbent pad comprising: a liquid-permeable upper layer, a liquid-permeable lower layer, and an absorbent layer disposed between said upper and lower layers, wherein said upper and lower layers extend outwardly beyond the periphery of said intermediate layer, and said upper layer and said lower layer are attached directly to one another around the entire perimeter of said intermediate layer, such that said intermediate absorbent layer is confined within the bounds of said upper and said lower layers, said upper layer comprises a spunbonded/meltblown/spunbonded trilaminate construction selected from the group consisting of polyolefin, polyester, and polyamide thermoplastic fibers having hydrophilic composition coated thereon, and said lower layer comprises a nonwoven fibrous web having hydrophilic composition coated thereon, and wherein said lower layer has a greater amount of said hydrophilic composition coated thereon than said upper layer.

27. An absorbent pad according to claim 26, wherein said spunbonded/meltblown/spunbonded trilaminate is polypropylene.

28. An absorbent pad according to claim 26, wherein said lower layer is a spunbonded nonwoven.

29. An absorbent pad according to claim 26, wherein said lower layer hydrophilic composition is present on said lower layer in an amount from 0.5 to 1.0 percent based on the weight of said lower layer and said upper layer hydrophilic composition is present on said upper layer in an amount from 0.1 to 0.35 percent based on the weight of said upper layer.

30. An absorbent pad according to claim 26, wherein said upper and lower layer hydrophilic compositions are independently selected from the group consisting of alkylphenol ethoxylates, alkylphenyl polyethylene glycol ethers (including alkylaryl polyether alcohol, polyethylene glycol mono-(4-octylphenyl) ether, polyethylene glycol mono-(4-tert-octylphenyl) ether, POE octylphenol, ethoxylated octylphenol, octylphenol EO(X) where X stands for the average units of ethylene oxide), polyethylene glycol, alkylphenol, polypropylene glycol, polysorbates, fatty amine oxides, linear alcohol ethoxylates, alkanolamides, block copolymers of ethylene oxide and propylene oxide, and mixture thereof.

31. A case-ready package comprising:

a support member;

a lid member;

a food product; and an absorbent pad comprising:

a liquid-permeable upper layer in contact with a food product, and a liquid-permeable lower layer, and an intermediate absorbent layer wherein said upper layer and said lower layer extend outwardly beyond the periphery of said intermediate layer, and said upper layer and said lower layer are attached directly to one another around the entire perimeter of said intermediate layer, such that said intermediate absorbent layer is confined within the bounds of said upper and said lower layer, and wherein said upper layer comprises a nonwoven fibrous web having a hydrophilic composition coated on said upper layer, and wherein the rate of liquid ingress through said upper layer is controlled by changing the amount of said hydrophilic composition coated on said upper layer, and said lower layer comprising a nonwoven fibrous web having a hydrophilic composition coated on said lower layer, wherein the amount of said hydrophilic composition on said lower layer is greater than the amount of said hydrophilic composition on said upper layer, such that said lower layer wicks said liquids at a rate that is greater than the rate at which said upper layer wicks said liquids.

32. The case-ready package according to claim 31, wherein said food product is selected from the group consisting of meat, cheese, poultry, and produce.

33. The case-ready package according to claim 31, wherein said food product is poultry.

34. The case-ready package according to claim 31, wherein said package has a modified atmosphere between said support member end said lid member.

35. The case-ready package according to claim 34, wherein the atmosphere has been substantially evacuated from within said case-ready package.

36. A case-ready package comprising:

a support member;

a lid member;

a food product; and an absorbent pad comprising:

a liquid-permeable upper layer in contact with a food product, and a liquid-permeable lower layer, and an intermediate absorbent layer wherein said upper layer and said lower layer extend outwardly beyond the periphery of said intermediate layer, and said upper layer and said lower layer are attached directly to one another around the entire perimeter of said, intermediate layer, such that said, intermediate absorbent layer is confined within the bounds of said upper and said lower layer, and wherein said upper layer comprises a nonwoven fibrous web having a hydrophilic composition coated on said upper layer, and wherein the rate of liquid ingress through said upper layer is controlled by changing the amount of said hydrophilic composition coated on said upper layer; and said lower layer comprising a nonwoven fibrous web having a hydrophilic composition coated on said lower layer, wherein the amount of said hydrophilic composition on said lower layer is greater than the amount of said hydrophilic composition on said upper layer, such that said lower layer wicks said liquids at a rate that is greater than the rate at which said upper layer wicks said liquids, and wherein said lower layer nonwoven is selected from the group consisting of polyolefin, polyester, polypropylene, and polyamide.

* * * * *